US006248491B1

(12) United States Patent
Takayanagi et al.

(10) Patent No.: US 6,248,491 B1
(45) Date of Patent: Jun. 19, 2001

(54) TONER FOR ELECTROSTATIC IMAGE DEVELOPMENT

(75) Inventors: Hitoshi Takayanagi, Omiya; Minoru Nomura, Kitaadachi-gun; Takashi Ito, Tokyo; Kenichi Hirabayashi, Kitaadachi-gun; Yukiko Soma, Tokyo; Toshiro Kogawara, Iwatsuki; Toyomi Hashizume, Ichihara; Kazuo Itoya, Yachiyo, all of (JP)

(73) Assignee: Dainippon Ink and Chemical Inc., Tokyo (JP)

( * ) Notice: Subject to any disclaimer, the term of this patent is extended or adjusted under 35 U.S.C. 154(b) by 0 days.

(21) Appl. No.: 09/666,555

(22) Filed: Sep. 21, 2000

(30) Foreign Application Priority Data

Sep. 24, 1999 (JP) ..... 11-270106
Sep. 30, 1999 (JP) ..... 11-279051
Nov. 30, 1999 (JP) ..... 11-339458

(51) Int. Cl.[7] ..... G03G 9/087
(52) U.S. Cl. ..... 430/109; 430/111; 430/137
(58) Field of Search ..... 430/109, 111

(56) References Cited

U.S. PATENT DOCUMENTS 5,342,272 * 8/1994 Ito et al. ..... 430/109
5,691,095 12/1995 Shinzo et al. .
5,976,752 * 11/1999 Matsunaga et al. ..... 430/111
6,017,670 * 1/2000 Hashizume et al. ..... 430/109
6,077,639 * 6/2000 Semura et al. ..... 430/109
6,096,467 * 8/2000 Shimizu et al. ..... 430/111

FOREIGN PATENT DOCUMENTS 5-66600 3/1993 (JP) .
8-211655 8/1996 (JP) .
11-44969 2/1999 (JP) .

* cited by examiner

*Primary Examiner*—Roland Martin
(74) *Attorney, Agent, or Firm*—Armstrong, Westerman, Hattori, McLeland & Naughton, LLP

(57) ABSTRACT

The present invention provides a polyester resin toner which has good fixing properties and is superior in image quality in a heat roller fixation system without employing an anti-offset solution, and which has a spherical or generally spherical shape and has a small particle diameter, and a method of producing the same. In a toner for electrostatic image development comprising a binder resin and a colorant, said binder resin is made of a polyester resin. Furthermore, the weight-average molecular weight as measured by gel permeation chromatography of a tetrahydrofuran-soluble fraction of said polyester resin contained in the toner is 30,000 or more and the weight-average molecular weight/number-average molecular weight is 12 or more and, moreover, the area ratio of a molecular weight of 600,000 or more is 0.5% or more and the area ratio of a molecular weight of 10,000 or less is within a range of 20–80%. The toner for electrostatic image development has a spherical or generally spherical shape having the average circularity (average value of circularity defined by (perimeter of a circle having the same area as that of a projected area of particles)/(perimeter of a projected image of particles)) of 0.97 or more.

12 Claims, No Drawings

TONER FOR ELECTROSTATIC IMAGE DEVELOPMENT

BACKGROUND OF THE INVENTION

1. Field of the Invention

The present invention relates to a toner for electrostatic image development which is employed in electrophotographic copying machines, printers, and facsimiles, and a method of producing the same. The present invention also relates to a toner for electrostatic image development which can also be preferably employed in the development of a toner-jet printer.

2. Description of the Related Art

In electrophotographic copying machines, printers, and facsimiles, the following needs to the toner have recently been enhanced for cost reduction and size reduction of machines as well as power saving and resource saving, including a further improvement in quality of the printed image. The needs include improvement in definition and gradient of the printed image, reduction in thickness of the toner layer, reduction in amount of wasted toner, reduction in particle diameter and spheroidizing of the toner for reducing the amount of the toner consumed per page, decrease in fixing temperature for reduction in power consumed, oilless fixation for simplification of machines, improvement in hue, transparency and gloss in full-color image, reduction in VOC (volatile organic compound) during the fixation, which is likely to exert an adverse influence on human health, and the like.

Reduction in particle diameter of the powdered toner prepared by a pulverization method, which has been employed for a long time, can be basically carried out. However, with the reduction in particle size, there arise these problems that (1) it becomes difficult to control charge because of an increase in the amount of colorants and waxes exposed on the surface of toner particles, (2) the fluidity of the powder is lowered by the irregular shape of the toner particles and (3) the energy cost required for the production increases, thus making it difficult to sufficiently satisfy the needs described above.

Therefore, a development of a spherical toner having a small particle diameter has been made intensively by the polymerization method or emulsification/dispersion method. Although various methods have been known as the method of producing a toner using the polymerization method, there has widely been employed the suspension polymerization method, which comprises uniformly dissolving and dispersing a monomer, a polymerization initiator, a colorant and a charge control agent, adding the mixture in an aqueous medium containing a dispersion stabilizer while stirring to form oil droplets and heating, thereby to cause the polymerization reaction to obtain toner particles. Although the reduction in particle diameter and spheroidizing can be satisfactorily conducted by the polymerization method, a principal component of the binder resin is limited to a radically-polymerizable vinyl polymer and toner particles made of a polyester resin or epoxy resin suited for use as a color toner cannot be produced by the polymerization method. It is difficult to reduce VOC (volatile organic compound made of an unreacted monomer) by the polymerization method and its improvement is required.

As is disclosed in Japanese Patent Application, First Publication No. Hei 5-66600 and Japanese Patent Application, First Publication No. Hei 8-211655, the method of producing the toner using the emulsification/dispersion method is a method of mixing a mixture of a binder resin and a colorant with an aqueous medium and emulsifying them to obtain toner particles and has these advantages that (1) possible binder resins can be widely selected, (2) reduction in VOC is easy to realize and (3) the concentration of the colorant is easy to change optionally within a range of low to high value, as compared with the polymerization method, in addition to the advantage that is easy to cope with the reduction in particle diameter and spheroidizing of the toner similar to the polymerization method.

It has generally been known that a polyester resin is more preferable than a styrene-acrylic resin as a binder resin for a toner, which can reduce the fixing temperature and forms a smooth image surface by sharp melting during the fixation, and a polyester resin having an excellent pliability is used in the color toner particularly preferably. As described above, since the polyester resin can not be employed as the principal component of the binder resin in the polymerization method, a spherical or generally spherical toner having a small particle diameter containing a polyester resin as the binder resin obtained by the emulsification/dispersion method has attracted special interest recently.

However, a polyester resin toner obtained by the emulsification/dispersion method which has hitherto been employed contains a straight-chain resin having a comparatively low molecular weight as the binder resin. Therefore, it is essential to coat a fixing heat roller with an anti-offset solution such as silicone oil and the silicone oil transfers to a printing paper or an OHP paper. So in addition to the problem of maintenance, are problems such as poor writing on printed sheet and greasiness due to oil. There was also a problem that the peel strength is not sufficient necessarily because it varies depending on the purposes.

BRIEF SUMMARY OF THE INVENTION

An object of the present invention is to provide a toner for electrostatic image development which has good fixing properties and is superior in image quality in a heat roller fixing system without employing an anti-offset solution, and which has a spherical or generally spherical shape and has a small particle diameter, and a method of producing the same.

As a result of diligent research by paying attention to the molecular weight distribution, structure, and acid value of the polyester resin employed as the binder resin, the present inventors have found a high-image quality spherical or generally spherical toner having oilless fixation properties and a preferable method of producing the same, thus completing the present invention.

That is, the present invention provides a toner for electrostatic image development, comprising a binder resin, a colorant, and a toner for electrostatic image development, comprising a binder resin, a colorant and a positive charge control agent, the binder resin being made of a polyester resin wherein the weight-average molecular weight as measured by gel permeation chromatography of a tetrahydrofuran-soluble fraction of the polyester resin contained in the toner is 30,000 or more and the weight-average molecular weight/number-average molecular weight is 12 or more and, moreover, the area ratio of a molecular weight of 600,000 or more is 0.5% or more and the area ratio of a molecular weight of 10,000 or less is within a range of 20–80%, and wherein the toner has a spherical or generally spherical shape having the average circularity (average value of circularity defined by (perimeter of a circle having the same area as that of a projected area of particles)/(perimeter of a projected image of particles)) of 0.97 or more.

When employing the toner for electrostatic image development described above, it becomes unnecessary to coat a fixing heat roller with an anti-offset solution during the formation of an image by heat roller fixation.

The spherical or generally spherical toner containing a polyester resin having a molecular weight/molecular weight distribution within a specific range according to the present invention has good fixation properties using the heat roller which is not coated with an anti-offset solution, thus obtaining an image with an excellent quality.

Such a powdered toner can be preferably produced by mixing a mixture containing a binder resin and a colorant as an essential component with an aqueous medium in the presence of a base, emulsifying the admixture to form resin particles containing the colorant, separating the particles from the liquid medium and drying the particles.

DETAILED DESCRIPTION OF THE INVENTION

In the measurement of the viscoelasticity of the toner, (a) the storage elastic modulus (G') at 110° C. and 1 Hz is preferably within a range of $1\times10^4$–$1\times10^5$ Pa and (b) the storage elastic modulus (G') at 140° C. and 1 Hz is preferably within a range of $1\times10^3$–$1\times10^4$ Pa.

The tetrahydrofuran-insoluble fraction of the polyester resin contained in the toner is within a range of 0.01–20% by weight, preferably within a range of 0.5–10% by weight, and more preferably within a range of 0.5–6% by weight. Furthermore, a blend resin of a crosslinked polyester resin and a straight-chain polyester resin is preferably employed as the binder resin.

It is preferable that the binder resin has a carboxyl group and the acid value of the binder resin is within a range of 1–30 KOHmg/g.

Wax is preferably contained. In that case, the wax is preferably selected from the group consisting of hydrocarbon waxes such as polypropylene wax, polyethylene wax and Fischer-Tropsch wax; synthetic ester waxes; and natural ester waxes such as carnauba wax and rice wax.

The toner for electrostatic image development with such a construction is obtained preferably by a production method comprising the first step of mixing a mixture containing a binder resin made of a polyester resin having a carboxyl group, a colorant, or a mixture containing a binder resin made of a polyester resin having a carboxyl group, a colorant, and a positive charge control agent with an aqueous medium in the presence of a base and emulsifying the admixture to form resin particles wherein the colorant are included in the binder resin, and the second step of separating the resin particles from the liquid medium and drying them.

The toner for electrostatic image development with such a construction is obtained more preferably by a production method comprising:

the first step of mixing a mixture containing a binder resin, and a colorant with an aqueous medium in the presence of a basic neutralizer and emulsifying the admixture to obtain a liquid medium of colored particles (I);

the second step of mixing a mixture containing, as an essential component, a resin capable of being provided with the self-water dispersibility and/or water solubility by neutralization and a positive charge control agent with an aqueous medium in the presence of a neutralizer and emulsifying the admixture to obtain a liquid medium of microparticles (II) containing the positive charge control agent, the average particle diameter of which is smaller than that of the colored particles (I);

The third step of adding the liquid medium of the microparticles (II) to the liquid medium of the colored particles (I), uniformly mixing them, adding a neutralizer having the reverse polarity as compared with the second step thereby to deposit the microparticles (II) on the surface of the colored particles (I); and the fourth step of separating the colored particles (I) with the microparticles (II) adhered on the surface from the liquid medium and drying to obtain toner particles.

The present invention will now be described in detail.

The polyester resin employed as the binder resin of the powdered toner of the present invention is synthesized by dehydration condensation of a polybasic acid and a polyhydric alcohol.

Examples of the polybasic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexanedicarboxylic acid. These polybasic acids can be used alone or in combination. Among these polybasic acids, an aromatic carboxylic acid is preferably employed. In order to take a crosslinked or branched structure to secure good fixing properties, a polyhydric carboxylic acid having three or more valances (e.g. trimellitic acid or an acid anhydride thereof) is preferably employed in combination with the dicarboxylic acid.

Examples of the polyhydric alcohol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adduct of bisphenol A and propylene oxide adduct of bisphenol A. These polyhydric alcohols can be used alone or in combination. Among these polyhydric alcohols, aromatic diols and alicyclic diols are preferably employed. In order to take a crosslinked or branched structure to secure good fixing properties, a polyhydric alcohol having three or more valances (e.g. trimethylolpropane, pentaerythritol, etc.) is preferably employed in combination with the diol.

A hydroxyl group at polymer terminal and/or a carboxyl group may be esterified by further adding monocarboxylic acid and/or monoalcohol to the polyester resin obtained by the polycondensation of the polyhydric carboxylic acid and polyhydric alcohol, thereby controlling the acid value of the polyester resin. Examples of the monocarboxylic acid include acetic acid, acetic anhydride, benzoic acid, trichloroacetic acid, trifluoroacetic acid, propionic anhydride and the like. Examples of the monoalcohol include methanol, ethanol, propanol, octanol, 2-ethylhexanol, trifluoroethanol, trichloroethanol, hexafluoroisopropanol, phenol and the like.

The polyester resin can be produced by the condensation reaction of the polyhydric alcohol and polyhydric carboxylic acid according to a conventional method. For example, it can be produced by charging the polyhydric alcohol and polyhydric carboxylic acid in a reaction vessel equipped with a thermometer, a stirrer and a dropping condenser, heating them to 150–250° C. in the presence of an inert gas (e.g. nitrogen gas), continuously removing a low-molecular compound out of the reaction system, terminating the reaction at a point of time where the acid value reached a predetermined value, and cooling to obtain a desired reaction product.

In the synthesis of the polyester resin, a catalyst may be employed. Examples of the catalyst include esterification catalysts, for example, organometallic compound (e.g. dibutyltin dilaurate and dibutyltin oxide, etc.) and metal alkoxide (e.g. tetrabutyl titanate, etc.). In case the carboxylic acid component is a lower alkyl ester, there can be used ester interexchange catalysts, for example, metal acetate (e.g. zinc acetate, lead acetate, magnesium acetate, etc.), metal oxide (e.g. zinc oxide, antimony oxide, etc.) and metal alkoxide (e.g. tetrabutyl titanate, etc.). The amount of the catalyst is preferably within a range of 0.01–1% by weight based on the total amount of the raw materials.

It is necessary to obtain good fixation properties that the polyester resin contained in the toner as a principal constituent component of the toner of the present invention satisfies all of the following conditions:

(1) the weight-average molecular weight is 30,000, and more preferably 37,000 or more;

(2) the weight-average molecular weight Mw/number-average molecular weight Mn is 12 or more, and more preferably 15 or more;

(3) the area ratio of the component having the molecular weight of 600,000 or more is 0.5% or more, and more preferably 0.7% or more; and (4) the area ratio of a molecular weight of 10,000 or less is within a range of 20–80%, and more preferably within a range of 30–70% in the measurement of the molecular weight by gel permeation chromatography (GPC) of the tetrahydrofuran (THF)-soluble fraction of the polyester resin contained in the toner.

The molecular weight of the resin in the present invention is determined in the following manner. That is, the THF-soluble fraction of the polyester resin contained in the toner is measured in a THF solvent (flow rate: 0.6 ml/min, temperature: 40° C.) employing GPC·HLC-8120 produced by Tosoh Corp. and three columns·TSK gel Super HM-M (15 cm) produced by Tosoh Corp, and then the molecular weight is calculated by employing a molecular weight calibration curve made by a monodisperse polystyrene standard sample.

The measured value of the GPC measurement mentioned in the present invention is not the measured value of raw material resin but that of the resin which is contained in the toner. The resin which is contained in the toner and which get heat and strain in the kneading process might have a different GPC measurement value from raw material resin.

The high-molecular component having the molecular weight of about 600,000 or more is required to secure the anti-offset properties. It is essential for the toner of the present invention to contain the resin component having the molecular weight of about 600,000 or more. On the other hand, the low-molecular component having the molecular weight of about 10,000 or less is required to lower the melt viscosity of the toner, thereby to attain sharp melting properties and to lower the fixation initiation temperature. It is also essential for the toner of the present invention to contain the resin component having the molecular weight of 10,000 or less. To obtain good fixation properties such as oilless fixation, the binder resin must have a broad molecular weight distribution. In the formation of the toner particles employing the emulsification/dispersion method, it is effective to contain the low-molecular component in view of an improvement in particle size distribution properties. The toner of the present invention preferably contain the tetrahydrofuran-insoluble fraction in the amount within a range of 0.01–20% by weight, preferably within a range of 0.5–10% by weight, and more preferably within a range of 0.5–6% by weight, based on the total amount of the binder resin.

The amount of the tetrahydrofuran-insoluble fraction is determined in the following manner That is, 1 g of the toner is accurately weighed and completely dissolved by adding in 40 ml of tetrahydrofuran. After 2 g of RAZIORAITO (Showa Kagaku Koqyo) (#700) is uniformly disposed on a funnel (diameter: 40 mm) on which a Kiriyama filter paper (No. 3) is placed, the solution is filtered and a cake is put in an aluminum Petri dish. After drying at 140° C. for one hour, the dry weight is measured. Then, a value (percentage) is calculated by dividing the residual resin amount in the dry weight by the initial toner sample amount and this value is taken as the insoluble fraction. Although additives such as pigment, wax, external additive and the like are contained in the toner, the THF-insoluble fraction of the binder resin is calculated considering the content of them and whether they are soluble or not in THF. The tetrahydrofuran-insoluble fraction of the binder resin is measured by the same method.

The relation between the viscoelasticity and fixation properties will now be described.

The binder resin for toner is a typical viscoelastic body and its Theological characteristics have a close relation with the fixation properties of the toner. Particularly, the storage elastic modulus (G') relates to a cohesive force of the toner. When the storage elastic modulus of the toner is too low, the adhesion to a transfer paper becomes advantageous because of low internal cohesive force, however, the anti-offset properties at high temperature are lowered, thereby impairing the oilless fixation properties. To the contrary, when the storage elastic modulus is too high, the cohesive force increases and offset at high temperatures can be prevented, however, the fixation properties at low temperatures are impaired.

Accordingly, the toner having oilless fixation properties, excellent fixation properties at low temperatures and offset properties at high temperatures higher than a fixed temperature has specific Theological characteristics capable of retaining the storage elastic modulus at a fixed value or more since the beginning of the fixation, rapidly lowering the elastic modulus up to the fixation temperature and retaining the elastic modulus even at high temperature without lowering to a fixed value or less for prevention of hot offset.

It is usually considered that the nip time of the hot roller is within a range of 20–100 msec and the corresponding measured frequency on measurement of the dynamic viscoelasticity is within a range of 10–100 rad/sec. In the present invention, the measured frequency was 1 Hz (6.28 rad/sec). In light of the time-hour reduction rule of the viscoelasticity and the results of the frequency dispersion measurement where the elastic modulus increases with the increase of the frequency, it was concluded to be proper to judge the oilless fixation properties and fixation properties at low temperature at the storage elastic modulus at 110° C. and to evaluate hot offset, which occurs at about 180–200° C., at 140° C.

As a result, it has been found that:

(a) the oilless fixation properties can not be attained when the storage elastic modulus at 110° C. is lower than $1\times10^4$ Pa, while the fixation initiation temperature becomes higher when the storage elastic modulus is higher than $1\times10^5$ Pa, and (b) the anti-offset properties at high temperatures are lowered and the fixation range can not be secured when the storage elastic modulus (G') at 140° C. and 1 Hz is lower than $1\times10^3$ Pa, while the fixation properties at low temperatures are impaired because of too high crosslink density when the storage elastic modulus is higher than $1\times10^4$ Pa.

That is, the conditions capable of producing the toner of the present invention, which has the oilless fixation properties and reconciles the fixation properties at low temperatures and anti-offset properties at high temperatures, are preferably as follows:

(a) the storage elastic modulus at 110° C. is within a range of $1\times10^4$–$1\times10^5$ Pa, and (b) the storage elastic modulus (G') at 140° C. and 1 Hz is within a range of $1\times10^3$–$1\times10^4$ Pa.

The viscoelastic characteristic value in the present invention is a value measured by a rotary plate type rheometer (RDS, produced by Rheometrics Co.) in the following manner. Employing a parallel plate having a diameter of 25 mm, a sample having a weight of about 1.0 g is heated to a temperature within a range of about 50–200° C. at a heating speed of about 2° C./min while applying a frequency of 1 Hz and applying a strain of 50% or less and measured.

As the polyester resin employed in the toner of the present invention, a kind of a polyester resin satisfying the constituent features described above may be employed, but it is preferable to employ a resin prepared by blending a crosslinked or branched polyester resin having high molecular weight and high viscosity with a straight-chain polyester resin having low molecular weight and low viscosity in view of practical production. As used herein, term "crosslinked resin" refers to a resin containing a component insoluble in a solvent such as tetrahydrofuran and the term "branched resin" refers to a resin which contains a polyfunctional component having three or more valances but is soluble in a solvent such as tetrahydrofuran and, furthermore, the term "straight-chain resin" refers to a resin containing no crosslinking agent component. The term "high-molecular resin" refers to a resin wherein the weight-average molecular weight of the tetrahydrofuran-soluble fraction is about 100,000, and the resin may contain the tetrahydrofuran-insoluble fraction in the amount of about 20% by weight or less. The term "low-molecular resin" refers to a resin having the weight-average molecular weight of about 10,000 or less. A blend resin of the crosslinked resin and the straight-chain resin is preferably employed to attain good fixation range in the oilless fixation system, which is suitable for the present invention. The blend ratio of the crosslinked resin to the straight-chain resin is preferably within a range of 20:80–80:20, and more preferably within a range of 30:70–70:30.

The acid value (mg of KOH required to neutralize 1 g of a resin) of the polyester resin is preferably within the range of 1–30 KOHmg/g because the above molecular weight distribution is easily obtained and the particle size distribution of the toner particles by means of the emulsification/dispersion method are easily secured and, furthermore, the resulting toner having good environmental stability (stability of charge characteristics when the temperature and humidity change) is easily retained. In case of the positive-charge toner for electrostatic image development, the acid value is more preferably within a range of 1–20 KOHmg/g. The acid value of the polyester resin can be adjusted by controlling a carboxyl group at terminal of the polyester by means of the blend ratio and reaction rate of the polybasic acid and polyhydric alcohol as the raw material. Alternatively, those having a carboxyl group in a principal chain of the polyester can be obtained by employing trimellitic anhydride as the polybasic acid component.

The glass transition temperature of the polyester resin is preferably within a range of 35–100° C., and is more preferably within a range of 50–80° C. in view of balance between the storage stability and fixation properties of the toner. When the glass transition temperature is less than 35° C., the toner tends to cause blocking (phenomenon wherein particles of the toner agglomerate to form an agglomerate) during the storage or in a developing apparatus. On the other hand, when the glass transition temperature exceeds 100° C., the fixation temperature of the toner increases, which is not preferable.

The polyester resin described above is preferably employed in the binder resin of the toner of the present invention. If necessary, other resins may be used in combination as far as the amount is less than 40% by weight based on the binder resin. Examples of the other resin include styrene-acrylic resin, epoxy resin, polyamide resin and the like. Also in this case, the acid value of the entire binder resin is within a range of 1–30 KOHmg/g and it is necessary that the polyester resin must satisfy the following conditions:

(1) the weight-average molecular weight is 30,000, and more preferably 37,000 or more;

(2) the weight-average molecular weight Mw/number-average molecular weight Mn is 12 or more, and more preferably 15 or more;

(3) the area ratio of the component having the molecular weight of 600,000 or more is 0.5% or more, and more preferably 0.7% or more; and (4) the area ratio of a molecular weight of 10,000 or less is within a range of 20–80%, and more preferably within a range of 30–70% in the measurement of the molecular weight by gel permeation chromatography (GPC) of the tetrahydrofuran-soluble fraction.

Wax (releasant) is preferably employed in the toner of the present invention and examples of the wax include petroleum wax (e.g. paraffin wax, oxidized paraffin wax, microcrystalline wax, etc.), mineral wax (e.g. montan wax, etc.), vegetable wax (e.g. carnauba wax, rice wax, etc.), polyolefin wax, oxidized polyolefin wax, Fischer-Tropsch wax and the like. Among these waxes, carnauba wax, and rice wax are particularly preferable in the toner of the present invention.

The melting point of the wax is not specifically limited, but is preferably 150° C. or lower in view of the anti-offset properties. In view of the fixation properties and storage stability, it is preferably within a range of 50–120° C. The solid wax may be used as it is, or the wax may be used in the state of an emulsion. The wax is preferably dispersed in the toner and is more preferably dispersed in the average-particle diameter of 1 $\mu$n or less. The amount of the wax is preferably within a range of 1–40% by weight based on the toner. When the amount is less than 1% by weight, the releasability is liable to be insufficient. On the other hand, when the amount exceeds 40% by weight, the wax is liable to be exposed on the surface of the toner particles, thereby lowering the charge characteristics and storage stability.

The positive charge control agent employed in the toner of the present invention is not specifically limited, and there can be employed known positive charge control agents, which have conventionally employed for toner, such as nigrosine dye, quaternary ammonium compound, onium compound, triphenylmethane compound and the like. A compound having a basic group such as amino group, imino group, N-hetero ring or the like, for example, tertiary amino group-containing styrene-acrylic resin also serves as the positive charge control agent, and can be used alone or in combination with the above positive charge control agent. According to the purposes, a very small amount of a negative charge control agent such as azo dye metal complex, salicylic acid derivative metal complex or the like can be used in combination with these positive charge control agents.

Hereinafter, the charge control agent is abbreviated to CCA.

The amount of CCA in the toner of the present invention is within a range of about 0.01–6% by weight. In case CCA is fixed on the surface of the toner particles as described in claim 8, the amount of CCA may be small such as about 0.01–0.5%. However, in case CCA is included in the toner and is partially exposed as described in claim 7, the amount of CCA is preferably increased to 0.5–6% by weight.

The colorant which can be employed in the toner of the present invention is not specifically limited, and conventionally known colorants can be employed. The pigment is preferable and examples thereof include the followings.

Examples of the black pigment include Carbon Black, Cyanine Black, Aniline Black, Ferrite, Magnetite and the like. Alternatively, there can be used black pigments prepared from the following color pigments.

Examples of the yellow pigment include Chrome Yellow, Zinc Yellow, Cadmium Yellow, Yellow Iron Oxide, ocher, Titanium Yellow, Naphthol Yellow S, Hansa Yellow 10G, Hansa Yellow 5G, Hansa Yellow G, Hansa Yellow GR, Hansa Yellow A, Hansa Yellow RN, Hansa Yellow R, Pigment Yellow L, Bendizine Yellow, Bendizine Yellow G, Bendizine Yellow GR, Permanent Yellow NCG, Vulcan Fast Yellow 5G, Vulcan Fast Yellow R, Quinoline Yellow Lake, Anthragen Yellow 6GL, Permanent Yellow FGL, Permanent Yellow H10G, Permanent Yellow HR, Anthrapyrimidine Yellow, Isoindolinone Yellow, Cromophthal Yellow, Nobopalm Yellow H2G, Condensed Azo Yellow, Nickel Azo Yellow, Copper Azomethin Yellow and the like.

Examples of the red pigment include Chrome Orange, Molybdenum Orange, Permanent Orange GTR, Pyrazolone Orange, Vulcan Orange, Indanthrene Brilliant Orange RK, Indanthrene Brilliant Orange G, Benzidine Orange G, Permanent Red 4R, Permanent Red EL, Permanent Red F5RK, Lithol Red, Pyrazolone Red, Watchung Red, Lake Red C, Lake Red D, Brilliant Carmine 6B, Brilliant Carmine 3B, Rhodamine Lake B, Arisaline Lake, Permanent Carmine FBB, Perinone Orange, Isoindolinone Orange, Anthanthrone Orange, Pyranthrone Orange, Quinacridone Red, Quinacridone Magenta, Quinacridone Scarlet, Perylene Red and the like.

Examples of the blue pigment include Cobalt Blue, Cerulean Blue, Alkaline Blue Lake, Peacock Blue Lake, Phanatone Blue 6G, Victoria Blue Lake, Metal-free Phthalocyanine Blue, Copper Phthalocyanine Blue, Fast Sky Blue, Indanthrene Blue RS, Indanthrene Blue BC, Indigo and the like.

The amount of the colorant is preferably within a range of 1–50 parts by weight, and more preferably within a range of 3–15 parts by weight, based on 100 parts by weight of the binder resin.

To obtain the toner capable of attaining an excellent image quality, the toner is preferably spheroidized so as to secure good powder fluidity even after reduction in particle diameter. The powdered toner of the present invention requires the average circularity (average value of circularity defined by (perimeter of a circle having the same area as that of a projected area of particles)/(perimeter of a projected image of particles)) of 0.97 or more, and more preferably 0.98. The average circularity is also determined by taking a SEM (scanning electron microscope) photograph of the toner particles, followed by calculation, but is easily obtained by employing a flow type particle image analyzer FPIP-1000 produced by Toa Iyo Denshi Co., Ltd. In the present invention, the average circularity was measured by this apparatus.

To retain good friction charge characteristics even when the particle diameter of the toner is reduced, it is effective to prevent the colorant from exposing on the surface of the toner particles, that is, to attain a toner structure wherein the colorant is included in the toner particles. The impairment of the charge characteristics accompanying the reduction in particle diameter of the toner is also caused by the fact that the colorant and other additives (e.g. wax, charge control agent, etc.) are partially exposed on the surface of the toner particles. Even if the content (% by weight) of the colorant is the same, the surface area of the toner particles is increased by the reduction in particle diameter and the proportion of the colorant, wax or the like to be exposed on the surface of the toner particles is increased. As a result, the composition of the surface of the toner particles drastically changes and the friction charge characteristics of the toner particles drastically change, thereby making it difficult to obtain proper charge characteristics.

According to the toner of the present invention and method of producing the same, since the colorant and wax are included in the binder resin, the charge characteristics are made uniform, thereby making it possible to easily obtain good printed image. It can be easily judged, for example, by observing the cross section of the particles employing TEM (transmission electron microscope) to examine that the colorant and wax are not exposed on the surface of the toner particles. More concretely, when the cross section, which was obtained by embedding the toner particles into a resin and cutting the resulting sample by a microtome, is optionally dyed with ruthenium tetraoxide and observed by TEM, it can be confirmed that the pigment and wax were included in the binder resin and dispersed in particles almost uniformly.

The toner of the present invention can be produced by mixing a mixture comprising, as an essential component, a binder resin containing a polyester resin as a principal component, and a colorant with an aqueous medium, emulsifying and dispersing the admixture to form resin particles containing the colorant, separating the particles from the liquid medium and drying the particles.

The positive-charge toner of the present invention can be preferably produced by any of the method, which comprises mixing a mixture comprising, as an essential component, a polyester resin, a colorant and a positive charge control agent with an aqueous medium in the presence of a basic neutralizer, emulsifying the admixture to form particles, separating the particles from the liquid medium and drying the particles, and the method comprising:

the first step of mixing a mixture containing, as an essential component, a polyester resin and a colorant with an aqueous medium in the presence of a basic neutralizer and emulsifying the admixture to obtain a liquid medium of colored particles (I);

the second step of mixing a mixture containing, as an essential component, a resin capable of being provided with the self-water dispersibility and/or water solubility by neutralization and a positive charge control agent with an aqueous medium in the presence of a neutralizer and emulsifying the admixture to obtain a liquid medium of microparticles (II) containing the positive charge control agent, the average particle diameter of which is smaller than that of the colored particles (I);

The third step of adding the liquid medium of the microparticles (II) to the liquid medium of the colored particles (I), uniformly mixing them, adding a neutralizer having the reverse polarity as compared with the second step thereby to deposit the microparticles (II) on the surface of the colored particles (I); and the fourth step of separating the colored particles (I) with the microparticles (II) adhered on the surface from the liquid medium and drying to obtain toner particles.

The formation of the polyester resin toner particles by means of such emulsification/dispersion method can be conducted in the absence of a solvent as disclosed in Japanese Patent Application, First Publication No. Hei 9-311502, and can also be conducted by employing an organic solvent as disclosed in Japanese Patent Application, First Publication No. Hei 8-211655 and Japanese Patent Application, First Publication No. Hei 10-319639. In the present invention, any particle formation method can also be employed.

The particle formation by means of the solvent-free method is characterized by (1) mixing a molten colored resin, which is prepared by melting a kneaded mixture of an acid group-containing polyester resin and a colorant with heating, with an aqueous medium, which contains a basic neutralizer and is heated to a temperature higher than the melting point of the polyester resin by heating and optionally pressurizing, (2) finely dispersing the molten colored resin in the aqueous medium by a mechanical means while maintaining the temperature of the mixture at the temperature higher than the melting point of the resin, and (3) rapidly cooling immediately after the dispersion to obtain a water dispersion of toner particles. This solvent-free method has such an advantage that the organic solvent is not employed, but has a difficulty in equipment as compared with the solvent method because the emulsification/dispersion is conducted at high temperature under high pressure.

The method of forming toner particles by means of the emulsification/dispersion method employing the organic solvent includes, for example, the method of particle formation without employing an emulsifier or a dispersion stabilizer by neutralizing an acid group with a basic neutralizer, thereby converting a binder resin into a self-water dispersible resin as disclosed in Japanese Patent Application, First Publication No. Hei 8-211655 Japanese Patent Application, First Publication No. Hei 10-319639 and the method of forming a resin particle, which is not dispersed in water, by employing an emulsifier, a dispersion stabilizer or the like as disclosed in Japanese Patent Application, First Publication No. Hei 1-15804. In the present invention, any method can be employed.

The term "self-water dispersible resin" refers to a resin having a functional group capable of converting into an anion, which can form a stable water dispersion without employing an emulsifier or a dispersion stabilizer under an operation of a water dispersion (water or a liquid medium containing water as a principal component) wherein portion or all of functional groups capable of being provided with the hydrophilicity are neutralized with a base.

The functional group capable of being provided with the hydrophilicity by the neutralization includes, for example, a so-called acid group such as carboxyl group, phosphoric group, sulfonic group, sulfuric group or the like. However, the carboxyl group is particularly preferable considering the moisture absorption properties which exert an adverse influence on the charge characteristics of the toner. Examples of the resin having these functional groups include styrene resin, (meth)acrylic resin, polyester resin, polyurethane resin, epoxy resin and the like.

Examples of the neutralizer of the acid group include, but are not limited to, inorganic base such as sodium hydroxide, potassium hydroxide, lithium hydroxide, calcium hydroxide, sodium carbonate, or ammonia; and organic base such as diethylamine, triethylamine, isopropylamine, or amine.

When employing, as the polyester resin which is the binder resin, a polyester resin which is not dispersed in water, i.e. a polyester resin having no self-water dispersibility, it is necessary to add an emulsifier and/or a dispersion stabilizer to a resin solution and/or an aqueous medium to be mixed it.

The dispersion stabilizer is preferably a water-soluble high-molecular compound and examples thereof include polyvinyl alcohol, polyvinyl pyrrolidone, hydroxyethylcellulose, carboxymethylcellulose and the like. The emulsifier includes various surfactants, for example, nonionic surfactant such as polyoxyethylene alkyl phenol ether; anionic surfactant such as sodium alkylbenzenesulfonate; and cationic surfactant. As a matter of course, two or more kinds of emulsifiers may be used in combination and two or more kinds of dispersion stabilizer may be used in combination. Generally, the dispersion stabilizer is principally employed in combination with the emulsifier.

When employing the emulsifier or dispersion stabilizer, the concentration of it in the aqueous medium is preferably controlled within a range of about 0.5–3% by weight.

Even when employing the resin, which can be provided with the self-water dispersibility by the neutralization, the emulsifier and/or the dispersion stabilizer may be optionally employed as far as the effects of the present invention are not impaired.

With respect to the method of particle formation without employing the emulsifier or dispersion stabilizer by neutralizing the acid group with the basic neutralizer, thereby converting the binder resin into the self-water dispersible resin and the method of particle formation employing the emulsifier or dispersion stabilizer, the former method is better than the latter method in the present invention for these reasons (1) better particle size distribution are obtained by neutralizing the acid group with the basic neutralizer, thereby converting the binder resin into the self-water dispersible resin when employing the polyester resin containing a high-molecular component and (2) when employing the emulsifier or dispersion stabilizer, it is hard to remove the emulsifier or dispersion stabilizer by washing with water after the particle formation.

Examples of the organic solvent employed to dissolve the binder resin and to disperse the colorant include hydrocarbons such as pentane, hexane, heptane, benzene, toluene, xylene, cyclohexane, and petroleum ether; halogenated hydrocarbons such as methylene chloride, chloroform, dichloroethane, dichloroethylene, trichloroethane, trichloroethylene, and carbon tetrachloride; alcohols such as methanol, ethanol, isopropanol, n-propyl alcohol, and butanol; ketones such as acetone, methyl ethyl ketone, and methyl isobutyl ketone; and esters such as ethyl acetate and butyl acetate. Two or more kinds of them may be used in combination. Among these organic solvents, methyl ethyl ketone is preferable because of ease of removing the solvent and ease of forming particles.

The method of producing the kneaded mixture wherein the colorant and wax are dispersed in the binder resin may be a conventionally known method and is not specifically limited, but may be the method of mixing these powders and sufficiently kneading employing any of a twin-screw extruder, a kneader and a twin roll. Since the breakage of the high-molecular component of the binder resin occurs sometimes in such a kneading step, it is preferable to select the raw resin after previously confirming a change in molecular weight during the kneading of the binder resin to produce a toner comprising the binder resin having a specific range of the molecular weight like the toner of the present invention.

The kneaded mixture thus obtained, wherein the colorant and wax are dispersed in the binder resin, can be employed in the emulsification/dispersion step as it is in the solvent-free method. In the solvent method, the kneaded mixture is employed in the emulsification/dispersion step after dissolving and dispersing in the organic solvent as described above.

Another method of producing an organic solvent solution of the kneaded mixture, wherein the colorant and wax are dispersed in the binder resin, includes the method of dissolving the binder resin in the organic solvent, adding the colorant and wax and dispersing them employing a general mixing/dispersing apparatus such as despa (dispersion stirrer), ball mill, beads mill, sand mill, continuous beads mill or the like, which is suitable for use in the present invention.

Examples of the apparatus for mixing the kneaded mixture of the binder resin and colorant or its organic solvent solution with the aqueous medium and emulsifying the admixture include continuous emulsification/dispersion apparatuses such as a Homomixer (produced by Tokushu Kika Kogyo Co., Ltd.), a stirrer disclosed in Japanese Patent Application, First Publication No. Hei 9-114135, a Slasher (produced by Mitsui Mining Co., Ltd.), a Cavitron (produced by Eurotec, Ltd.), a Microfluidizer (produced by Mizuho Kogyo Co., Ltd.), a Munton-Golin Homogenizer (produced by Golin Co.), a Nanomizer (produced by Nanomizer Co., Ltd.), a Static Mixer (produced by Noritake Company) and the like.

With respect to the dispersion of the spherical or generally spherical colored resin particles obtained by the emulsification, the organic solvent is preferably removed by employing a means such as distillation when employing the organic solvent. Then, the aqueous dispersion is filtered by a means such as filtration and the resulting particles are dried to obtain toner particles. The colored resin particles obtained by employing the emulsifier and dispersion stabilizer is preferably employed after sufficiently washing.

In case the resin particles are obtained by employing the self-water dispersible resin, which is obtained by neutralizing the acid group-containing polyester resin, as the binder resin, with a basic neutralizer, there is preferably employed the method of subjecting a hydrophilic group, which is obtained by neutralizing with a basic compound on the surface of the particles, to a reverse neutralization treatment for returning the hydrophilic group to the original functional group employing an acidic neutralizer such as hydrochloric acid, sulfuric acid, phosphoric acid, acetic acid, oxalic acid or the like, thereby lowering the hydrophilicity of the particles, followed by removal of water, filtration and drying.

The method of producing the positive-charge toner of claim 8 will now be described.

The liquid medium of the colored particles (I) is obtained by mixing a mixture containing a polyester resin and a colorant as an essential component with an aqueous medium in the presence of a basic neutralizer, emulsifying the admixture, and removing an organic solvent under reduced pressure.

The resin employed in the step of mixing a mixture containing, as an essential component, a resin capable of being provided with the self-water dispersibility and/or water solubility by neutralization and a positive charge control agent with an aqueous medium in the presence of a neutralizer and emulsifying the admixture to obtain a liquid medium of microparticles (II) containing the positive charge control agent, the average particle diameter of which is smaller than that of the colored particles (I) may be a resin having an acidic group or a basic group, and is not specifically limited.

Examples of the functional group, which can be converted into a hydrophilic group by the neutralization, include acidic groups such as carboxyl group, phosphoric group, sulfonic group, sulfuric group and the like. Among these acidic groups, a carboxyl group is preferable. Examples of the basic group include primary, secondary and tertiary amino groups, quaternary ammonium group and the like. Among these basic groups, a tertiary amino group is preferable. Examples of the resin having these functional groups include styrene resin, (meth)acrylic resin, polyester resin, polyurethane resin, epoxy resin and the like, and a carboxyl group-containing styrene-(meth)acrylic resin or polyester resin is preferably employed.

Examples of the neutralizer of the acidic group include, but are not limited, to inorganic base such as sodium hydroxide, potassium hydroxide, lithium hydroxide, calcium hydroxide, sodium carbonate, or ammonia; and organic base such as diethylamine, triethylamine, or isopropylamine. Examples of the neutralizer of the basic group include inorganic acid such as hydrochloric acid, sulfuric acid, or phosphoric acid; and organic acid such as oxalic acid, formic acid, acetic acid, succinic acid, or p-toluenesulfonic acid.

It is necessary that the average particle diameter of the microparticles (II) is smaller than the particle diameter of the colored particles (I), and is preferably within a range of about 0.1–1 $\mu$m. The content of the charge control agent in the microparticles is preferably within a range of about 2–50% by weight, and is more preferably within a range of 3–20% by weight.

The amount of the microparticles (II) to be added to the colored particles (I) in the step of adding the liquid medium of the microparticles (II) to the liquid medium of the colored particles (I), uniformly mixing them, and depositing the microparticles (II) on the surface of the colored particles (I) employing a neutralizer is preferably within a range or about 0.1–10% by weight, and particularly preferably within a range of 0.5–5% by weight. The deposition of the microparticles (II) comprising a carboxyl group-containing resin and a positive charge control agent on the surface of the colored particles (I) is preferably conducted by adding an aqueous acid solution having a reverse polarity as compared with the production process of the microparticles (II) to the mixed solution medium of the colored particles (I) and microparticles (II) while stirring. In this case, the deposition with acid and salting-out are preferably employed in combination by adding a small amount of an inorganic salt such as calcium chloride to attain uniform deposition.

The colored particles, wherein the positive charge control agent is fixed on the surface, obtained in the above steps are fixed more firmly by mixing with stirring under heating (within a range of 40–80° C. depending on Tg of the resin) employing a stirrer such as Henschel mixer after drying.

The drying step will now be described. The drying can be conducted by employing any of conventional known method, and may be conducted at a temperature where the toner particles are not thermally fused or agglomerated under normal pressure or reduced pressure. The freeze-drying method can be employed. There is also a method of simultaneously separating and drying the toner particles from the aqueous medium employing a spray drier. The method of stirring and drying the powder under reduced pressure while heating at the where the toner particles are not thermally fused or agglomerated and the method of employing a flush-jet dryer (produced by Seisin Kigyo Co., Ltd.) capable of drying in a moment employing a heat-dry air flow are efficient and preferable.

In case the classification for removing coarse particles and microparticles to adjust the particle size distribution of the formed toner particles is required, it can be conducted by a conventionally known method employing a commercially available general air-flow type classifying machine for toner. In the state where the toner particles are dispersed in the liquid medium, water slurry of the toner particles may be classified by utilizing a difference in sedimentation properties depending on the particle diameter. The removal of the coarse particles can also be conducted by filtering water slurry of the toner particles employing a filter or a wet vibration sieve. With respect to the particle size distribution of the toner, a ratio of 50% particle volume diameter to 50% number particle diameter as measured by Coulter Multisizer of about 1.25 or less is preferable because good image is easily obtained.

The volume-average particle diameter of the spherical powdered toner of the present invention is preferably within a range of 1–13 $\mu$m in view of the resulting image quality, and is more preferably within a range of about 3–10 $\mu$m because good matching with a current machine is easily obtained. When the volume-average particle diameter becomes smaller, not only the definition and gradient are improved, but also the thickness of the toner layer for forming the printed image becomes smaller, thereby exerting the effect of reducing the amount of the toner to be consumed per page, which is preferable. Such a feature of the spherical toner having a small particle diameter remarkably appears when the particle diameter is within a range of about 3–6 $\mu$m.

The powdered toner particles after drying can be employed as a developing agent as it is, but its characteristics such as fluidity and charge characteristics are preferably improved by adding an external additive for toner such as inorganic oxide microparticles, organic polymer microparticles or the like to the surface of the toner particles. Examples of the external additive include silica, titanium oxide, aluminum oxide, vinyl (co)polymer and the like. These external additives are preferably added in the amount within a range of about 0.05–5% by weight based on the toner particles.

The toner of the present invention can be employed for development of an electrostatic latent image by means of the electrophotographic method, or employed as a one component developing agent or a two component developing agent mixed with a carrier. The carrier is not specifically limited, and there can be used conventionally known carriers such as iron powder, ferrite or magnetite, or carriers prepared by coating them with a resin.

The toner of the present invention can be preferably employed in a printer of a so-called toner-jet system employing the method of directly spraying a powdered toner, which is charged frictionally by employing a non-magnetic one component developing apparatus comprising a developing agent bearing roller and a layer control member, over a paper on a back surface electrode through a hole on a flexible printed board with an electrode having a function of controlling the amount of the toner to be passed in the vicinity, thereby forming an image. Since the toner of the present invention is superior in fixation properties and color characteristics and has a spherical shape, it becomes easy to control scattering of the toner in a toner-jet system as compared with a toner having an unfixed shape.

EXAMPLES

The following Examples and Comparative Examples further illustrate the present invention in detail, but the present invention is not limited thereto. In the following Examples and Comparative Examples, parts are by weight and water means deionized water.

(Synthesis Example A of polyester resin)

Employing 3.1% by mole of trimethylolpropane as the polyhydric alcohol, 51.7% by mole of terephthalic acid as the dihydric carboxylic acid, 19.2% by mole of polyoxypropylene(2,4)-2,2-bis(4-hydroxyphenyl)propane as the aromatic diol, and 26% by mole of ethylene glycol as the aliphatic diol, tetrabutyl titanate as the polymerization catalyst was charged in a separable flask in the amount of 0.3% by weight based on the total amount of monomers. The flask was equipped with a thermometer, a stirrer, a condenser and a nitrogen introducing tube at the upper portion and the mixture was reacted in a electrically heated mantle heater at 220° C. for 15 hours in a nitrogen gas flow under normal pressure and, after gradually evacuating, the reaction was continued under 10 mmHg. The reaction was followed employing the softening point in accordance with the ASTM·E28-517 standard, and the reaction was completed by terminating evacuation when the softening point reached a predetermined temperature.

(Synthesis Example B of polyester resin)

Employing 36.9% by mole of terephthalic acid and 9.2% by mole of isophthalic acid as the dicarboxylic acid, 22.5% by mole of polyoxypropylene(2,4)-2,2-bis(4-hydroxyphenyl)propane and 11.3% by mole of polyoxyethylene(2,4)-2,2-bis(4-hydroxyphenyl)propane as the aromatic diol, and 20.1% by mole of ethylene glycol as the aliphatic diol, tetrabutyl titanate as the polymerization catalyst was charged in a separable flask in the amount of 0.3% by weight based on the total amount of monomers. The flask was equipped with a thermometer, a stirrer, a condenser and a nitrogen introducing tube at the upper portion and the mixture was reacted in a electrically heated mantle heater at 220° C. for 15 hours in a nitrogen gas flow under normal pressure and, after gradually evacuating, the reaction was continued under 10 mmHg. The reaction was followed employing the softening point in accordance with the ASTM·E28-517 standard, and the reaction was completed by terminating evacuation when the softening point reached a predetermined temperature.

(Synthesis Example C of styrene-methacrylic resin)

200 Parts of methyl ethyl ketone was charged in a reaction vessel and heated to 80° C. Then, a mixture of 23 parts of acrylic acid, 180 parts of styrene, 54 parts of methyl methacrylate, 43 parts of 2-ethylhexyl acrylate and 2.2 parts of "Perbutyl-O" (produced by NOF Corporation) was added dropwise in a nitrogen atmosphere over two hours. After the completion of the dropwise addition, 0.6 parts of Perbutyl O was added to the reaction solution and the reaction was continued at 80° C. over 24 hours to obtain a resin.

(Physical properties of polyester resin used)

Resin A: crosslinkable polyester resin having the following physical properties: acid value: 8.5, Tg: 61.7° C., temperature at which viscosity as measured by a flow tester is 100,000 poise: 154° C., weight-average molecular weight of THF-soluble fraction: 75,400, weight/number-average molecular weight: 24.5, area ratio of molecular weight of 600,000 or more: 1.50%, THF-insoluble fraction: 4.5% by weight Resin B: straight-chain polyester resin having the following physical properties: acid value: 6.5, Tg: 52.8° C., temperature at which viscosity as measured by a flow tester is 100,000 poise: 92.4° C., weight-average molecular weight of THF-soluble fraction: 5,700, weight/number-average molecular weight: 2.8, area ratio of molecular weight of 600,000 or more: 0%, THF-insoluble fraction: 0% by weight (Physical properties of styrene-acrylic resin used)

Resin C: non-crosslinkable resin having an acid value of 60, Tg of 70° C. and a weight-average molecular weight of 50,000

In the present invention, the glass transition temperature Tg was measured at a heating speed of 10° C. per minute by the second run method using a Differential Scanning Calorimeter "DSC-50" produced by Shimadzu Corporation. The melt viscosity was measured at a nozzle diameter of 1.0 mmØ×1.0 mm, a load of 10 Kg and a heating speed of 6° C. per minute using a Flow Tester "CFT-500" produced by Shimadzu Corporation.

Example 1

52.2 Parts of a resin A, 34.8 parts of a resin B, 3 parts of carnauba wax No. 1 (produced by Nippon Seiro Co., Ltd.) and 10 parts of carbon black pigment "Elftex 8" (produced by Cabot Co.) were kneaded in a twin-screw kneader, and then the kneaded mixture was dissolved and dispersed in 150 parts of methyl ethyl ketone using despa to form a mill base. 750 Parts of the mill base and 27.3 parts of 1 N ammonia water were charged in a cylindrical vessel and, after controlling the liquid temperature to 13° C., 450 parts of water at a temperature of 13° C. was added by a single portion while stirring at 10000 rpm employing T. K. Robomix (homomixer produced by Tokusyu Kika Kogyo Co., Ltd., diameter of stirring portion: 30 mm). While maintaining the liquid temperature at 16–18° C., the stirring was continued for nine minutes, thus completing the particle formation.

MEK was removed by vacuum distillation, followed by filtration and washing with water. The wet cake was dispersed again in water and, after controlling the pH to 3 by adding an aqueous 1 N hydrochloric acid solution, filtration and washing with water were repeated. The wet cake was freeze-dried and then classified by an air-flow type classifying machine to obtain toner particles having the volume-average particle diameter of 5.8 μm and the average circularity of 0.985.

The toner particles were embedded into a resin and the resulting sample was cut by a microtome, and then the cross section dyed with ruthenium tetraoxide was observed by TEM (transmission electron microscope). As a result, the pigment and wax were included in the binder resin and dispersed in particles nearly uniformly.

2 Parts of a hydrophobic silica and 1 part of titanium oxide were externally added to 100 parts of the toner particles to obtain a negative-charge powdered toner 1. The glass transition temperature of the toner was 54.8° C. and the temperature at which the viscosity as measured by a flow tester is 100,000 poise was 118° C. The acid value of the binder resin was 7.7 and the weight-average molecular weight as measured by GPC of the THF-soluble fraction was 42,700 and, moreover, the weight-average molecular weight/number-average molecular weight was 15.7. Furthermore, the area ratio of the resin component having the molecular weight of 600,000 or more was 1.1% and the area ratio of the resin component having the molecular weight of 10,000 or less was 62.2%. The storage elastic modulus (110° C.) was 190000 Pa, while the storage elastic modulus (140° C.) was 1300 Pa.

Example 2

50 Parts of a phthalocyanine pigment "KET Blue 123" (produced by Dainippon Ink & Chemicals, Incorporation) and 50 parts of a resin B were kneaded by a twin roll to make a masterbatch. 8 Parts of this masterbatch, 55.75 parts of a resin A, 33.25 parts of a resin B and 3 parts of carnauba wax were kneaded in a twin-screw kneader, and then the kneaded mixture was dissolved and dispersed in 150 parts of methyl ethyl ketone using despa to form a mill base. 750 Parts of the mill base and 25.8 parts of 1 N ammonia water were charged in a cylindrical vessel and, after controlling the liquid temperature to 12° C., 487 parts of water at a temperature of 6° C. was added by a single portion while stirring at 10000 rpm employing T. K. Robomix (homomixer produced by Tokusyu Kika Kogyo Co., Ltd., diameter of stirring portion: 30 mm). While maintaining the liquid temperature at 16–18° C., the stirring was continued for 37 minutes, thus completing the particle formation.

MEK was removed by vacuum distillation, followed by filtration and washing with water. The wet cake was dispersed again in water and, after controlling the pH to 3 by adding an aqueous 1 N hydrochloric acid solution, filtration and washing with water were repeated. The wet cake was freeze-dried and then classified by an air-flow type classifying machine to obtain toner particles having the volume-average particle diameter of 5.7 μm and the average circularity of 0.983.

The toner particles were embedded into a resin and the resulting sample was cut by a microtome, and then the cross section dyed with ruthenium tetraoxide was observed by TEM (transmission electron microscope). As a result, the pigment and wax were included in the binder resin and dispersed in particles nearly uniformly.

2 Parts of a hydrophobic silica and 1 part of titanium oxide were externally added to 100 parts of the toner particles to obtain a negative-charge powdered toner 2. The glass transition temperature of this toner was 54.8° C. and the temperature at which the viscosity as measured by a flow tester is 100,000 poise was 117° C. The acid value of the binder resin was 7.7 and the weight-average molecular weight as measured by GPC of the THF-soluble fraction was 42,700 and, moreover, the weight-average molecular weight/number-average molecular weight was 15.7. Furthermore, the area ratio of the resin component having the molecular weight of 600,000 or more was 1.1% and the area ratio of the resin component having the molecular weight of 10,000 or less was 62.2%. Data of the viscoelasticity are shown in Table 1.

Examples 3 to 4

In the same manner as in Example 2, except that a quinacridone pigment "Toner Magenta E-02" (produced by Hoechst Industry) or a disazo pigment "KET Yellow 403" (produced by Dainippon Ink & Chemicals, Incorporation) was used in place of the phthalocyanine pigment, negative-charge powdered toners 3 and 4 were obtained, respectively.

As is apparent from the observation using TEM, the pigment and wax are included and, moreover, the volume-average particle diameter was 5.8 μm and the average circularity was 0.983, in both cases. The molecular weight and molecular weight distribution as measured by GPC of the THF-soluble fraction were the same as those in Example 2. Data of the viscoelastivity are shown in Table 1

Comparative Example 1

In the same manner as in Example 1, except that the blend ratio of the resin A to the resin B was changed to 4:6, a negative-charge powdered toner 5 having the volume-average particle diameter of 5.8 μm and the average circularity of 0.985 wherein the pigment and wax are included in the binder resin was obtained.

The glass transition temperature of this toner was 53.2° C. and the temperature at which the viscosity as measured by a flow tester is 100,000 poise was 113° C. The acid value of the binder resin was 7.3 and the weight-average molecular weight as measured by GPC of the THF-soluble fraction was 31,000 and, moreover, the weight-average molecular weight/number-average molecular weight was 11.8. Furthermore, the area ratio of the resin component having the molecular weight of 600,000 or more was 0.35% and the area ratio of the resin component having the molecular weight of 10,000 or less was 71.6%. Data of the viscoelasticity are shown in Table 1.

Comparative Example 2

In the same manner as in Example 1, except that the blend ratio of the resin A to the resin B was changed to 2:8, a negative-charge powdered toner 6 having the volume-average particle diameter of 5.8 μm and the average circularity of 0.98 wherein the pigment and wax are included in the binder resin was obtained.

The glass transition temperature of this toner was 53.0° C. and the temperature at which the viscosity as measured by a flow tester is 100,000 poise was 105° C. Data of the viscoelasticity are shown in Table 1.

Comparative Examples 3 to 4

A kneaded mixture prepared by kneading 52.2 parts of a resin A, 34.8 parts of a resin B, 3 parts of carnauba wax and 10 parts of a carbon black pigment "Elftex 8" (produced by Cabot Co.) in a twin-screw extruder was pulverized and then classified to obtain a negative-charge powdered toner 7 having the volume-average particle diameter of 5.8 μm and a negative-charge powdered toner 8 having the volume-average particle diameter of 7.8 μm, respectively. Any of these toners had the average circularity of 0.950, and the pigment and wax were partially exposed on the surface of the toner particles.

The glass transition temperature of this toner was 54.8° C. and the temperature at which the viscosity as measured by a flow tester is 100,000 poise was 118° C. The acid value of the binder resin was 7.7 and the weight-average molecular weight as measured by GPC of the THF-soluble fraction was 42,700 and, moreover, the weight-average molecular weight/number-average molecular weight was 15.7. Furthermore, the area ratio of the resin component having the molecular weight of 600,000 or more was 1.1% and the area ratio of the resin component having the molecular weight of 10,000 or less was 64.0%. Data of the viscoelasticity are shown in Table 1.

(Image formation test)

With respect to the negative-charge powdered toners 1 to 8 shown in the Examples and Comparative Examples, the image was formed by employing a commercially available non-magnetic single-component system printer (Epson LP-1700) and then the fogging, definition, gradient and image density were evaluated. The results are as shown in Table 1.

With respect to the negative-charge powdered toners 1 to 4 shown in the Examples, each toner and a silicone-coated ferrite carrier (particle diameter: 80 μm) were mixed in the toner concentration of 3% by weight and then the image formation test was conducted by employing a double-component system copying machine (Ricoh Imagio MF-530). As a result, good image was obtained in any case.

Example 5

52.2 Parts of a resin A, 34.8 parts of a resin B, 3 parts of carnauba wax No. 1 (produced by Nippon Seiro Co., Ltd.) and 10 parts of carbon black pigment "Elftex 8" (produced by Cabot Co.) were kneaded in a twin-screw extruder, and then the kneaded mixture was dissolved and dispersed in 150 parts of methyl ethyl ketone using despa to form a mill base. 750 Parts of the mill base and 27.3 parts of 1 N ammonia water were charged in a cylindrical vessel and, after controlling the liquid temperature to 13° C., 450 parts of water at a temperature of 13° C. was added by a single portion while stirring at 10000 rpm employing T. K. Robomix (homomixer produced by Tokusyu Kika Kogyo Co., Ltd., diameter of stirring portion: 30 mm). While maintaining the liquid temperature at 16–18° C., the stirring was continued for nine minutes, thus forming colored particles (I) having the average particle diameter of about 5.7 μm. Then, MEK was removed by vacuum distillation to obtain a water dispersion (solid content: 20% by weight) of the colored particles (I).

90 Parts of a resin C was dissolved in 122 parts of MEK (methyl ethyl ketone) and 111 parts of THF (tetrahydrofuran) was added. Furthermore, 102 parts of an aqueous 1 N sodium hydroxide solution and 10 parts of Bontron N-07 (produced by Orient Chemical Industries Incorporated) were added, followed by mixing in a homomixer. While stirring, 2160 parts of water was added in a single portion, thereby forming submicron microgranules (II) containing a positive charge control agent. Then, MEK and THF were removed by vacuum distillation to obtain a water dispersion (solid content: 5% by weight) of the colored particles (II).

To 500 parts of the water dispersion of the colored particles (I) thus obtained, 20 parts of the water dispersion of the microparticles (II) and 14.4 parts of an aqueous calcium chloride solution were added, followed by sufficient mixing. While stirring, an aqueous 0.1 N hydrochloric acid solution was added dropwise to control the pH to 2.5, thereby to deposit the microparticles (II) on the surface of the colored particles (I). The filtration and washing with water were repeated and the wet cake was freeze-dried. This dry powder was mixed with stirring in a Henschel mixer at 70° C., thereby to sufficiently fix and stabilize the microparticles (II) adhered on the surface. Then, the dry powder was classified by an air-flow type classifying machine to obtain toner particles having the volume-average particle diameter of 5.8 μm and the average circularity of 0.985.

The toner particles were embedded into a resin and the resulting sample was cut by a microtome, and then the cross section dyed with ruthenium tetraoxide was observed by TEM (transmission electron microscope). As a result, the pigment and wax were included in the binder resin and dispersed in particles nearly uniformly.

0.5 Parts of a silica HKV 2150 (produced by Clariant Co.) was externally added to 100 parts of the toner particles using a Henschel mixer to obtain a positive-charge powdered toner 9. The glass transition temperature of this toner was 55.0° C. and the temperature at which the viscosity as measured by a flow tester is 100,000 poise was 119° C. The acid value of the binder resin was 8.0 and the weight-average molecular weight as measured by GPC of the THF-soluble fraction was 43,000 and, moreover, the weight-average molecular weight/number-average molecular weight was 16.0. Furthermore, the area ratio of the resin component having the molecular weight of 600,000 or more was 1.2% and the area ratio of the resin component having the molecular weight of 10,000 or less was 62.0%.

Example 6

52.2 Parts of a resin A, 34.8 parts of a resin B, 3 parts of carnauba wax No. 1, 10 parts of carbon black pigment "Elftex 8" (produced by Cabot Co.) and 3 parts of Bontron N-07 were kneaded in a twin-screw kneader, and then the kneaded mixture was dissolved and dispersed in 150 parts of methyl ethyl ketone using despa to form a mill base. 750 Parts of the mill base and 27.3 parts of 1 N ammonia water were charged in a cylindrical vessel and, after controlling the liquid temperature to 13° C., 450 parts of water at a temperature of 13° C. was added by a single portion while stirring at 10000 rpm employing T. K. Robomix (homomixer produced by Tokusyu Kika Kogyo Co., Ltd., diameter of stirring portion: 30 mm). While maintaining the liquid temperature at 16–18° C., the stirring was continued for nine minutes, thus forming colored particles (I) having the average particle diameter of 5.7 μm. MEK was removed by vacuum distillation, followed by filtration and washing with water. The wet cake was dispersed again in water and, after controlling the pH to 2.5 by adding an aqueous 1 N hydrochloric acid solution, filtration and washing with water were repeated. The wet cake was freeze-dried and then classified by an air-flow type classifying machine to obtain toner particles having the volume-average particle diameter of 5.9 μm and the average circularity of 0.987.

The toner particles were embedded into a resin and the resulting sample was cut by a microtome, and then the cross section dyed with ruthenium tetraoxide was observed by TEM (transmission electron microscope). As a result, the pigment and wax were included in the binder resin and dispersed in particles nearly uniformly.

0.5 Parts of a silica HKV 2150 was externally added to 100 parts of the toner particles using a Henschel mixer to obtain a positive-charge powdered toner 10. The glass transition temperature of the toner was 54.8° C. and the temperature at which the viscosity as measured by a flow tester is 100,000 poise was 119° C. The acid value of the binder resin was 7.7 and the weight-average molecular weight as measured by GPC of the THF-soluble fraction was 42,700 and, moreover, the weight-average molecular weight/number-average molecular weight was 15.7. Furthermore, the area ratio of the resin component having the molecular weight of 600,000 or more was 1.1% and the area ratio of the resin component having the molecular weight of 10,000 or less was 62.2%.

Comparative Example 5

In the same manner as in Example 5, except that the blend ratio of the resin A to the resin B was changed to 4:6, a positive-charge powdered toner 11 having the volume-average particle diameter of 5.8 μm and the average circularity of 0.985 wherein the pigment and wax are included in the binder resin was obtained.

The glass transition temperature of this toner was 53.7° C. and the temperature at which the viscosity as measured by a flow tester is 100,000 poise was 114° C. The acid value of the binder resin was 7.6 and the weight-average molecular weight as measured by GPC of the THF-soluble fraction was 31,500 and, moreover, the weight-average molecular weight/number-average molecular weight was 11.9. Furthermore, the area ratio of the resin component having the molecular weight of 600,000 or more was 0.36% and the area ratio of the resin component having the molecular weight of 10,000 or less was 71.5%.

Comparative Example 6

In the same manner as in Example 6, except that the blend ratio of the resin A to the resin B was changed to 4:6, a positive-charge powdered toner 12 having the volume-average particle diameter of 5.9 μm and the average circularity of 0.987 wherein the pigment and wax are included in the binder resin was obtained.

The glass transition temperature of this toner was 53.2° C. and the temperature at which the viscosity as measured by a flow tester is 100,000 poise was 113° C. The acid value of the binder resin was 7.3 and the weight-average molecular weight as measured by GPC of the THF-soluble fraction was 31,000 and, moreover, the weight-average molecular weight/number-average molecular weight was 11.8. Furthermore, the area ratio of the resin component having the molecular weight of 600,000 or more was 0.35% and the area ratio of the resin component having the molecular weight of 10,000 or less was 71.6%.

Comparative Examples 7 to 8

A kneaded mixture prepared by kneading 52.2 parts of a resin A, 34.8 parts of a resin B, 3 parts of carnauba wax, 10 parts of a carbon black pigment "Elftex 8" (produced by Cabot Co.) and 3 parts of Bontron N-07 in a twin-screw extruder was pulverized and then classified to obtain a positive-charge powdered toner 13 having the volume-average particle diameter of 5.8 μm and a positive-charge powdered toner 14 having the volume-average particle diameter of 7.8 μm, respectively. Any of these toners had the average circularity of 0.950, and the pigment and wax were partially exposed on the surface of the toner particles.

The glass transition temperature of this toner was 54.8° C. and the temperature at which the viscosity as measured by a flow tester is 100,000 poise was 118° C. The acid value of the binder resin was 7.7 and the weight-average molecular weight as measured by GPC of the THF-soluble fraction was 42,700 and, moreover, the weight-average molecular weight/number-average molecular weight was 15.7. Furthermore, the area ratio of the resin component having the molecular weight of 600,000 or more was 1.1% and the area ratio of the resin component having the molecular weight of 10,000 or less was 64.0%.

(Image formation test)

With respect to a developing agent obtained by mixing 3 parts of each of the positive-charge powdered toners 9 to 14 shown in the Examples and Comparative Examples with 100 parts of a silicone-coated ferrite carrier (particle diameter: 80 μm), the image was formed by employing a commercially available copying machine (Z-52, produced by Sharp Corporation) and then the fogging, definition, gradient and image density were evaluated. The results are as shown in Table 2.

(Fixation properties test)

Employing the powdered toners 1 to 14 shown in the Examples and Comparative Examples, the respective printed papers were fixed by passing through a heat roller (oilless type) Ricoh Imagio DA-250 at a speed of 90 mm/second, and then a Cellophane tape was applied on the image after fixation. The surface temperature range of the heat roller when ID (image density) after peeling is 90% or more of the original ID and offset does not occur was defined as a "fixation temperature range". The measurement results are shown in Tables 1 and 2.

As a result of the test of the resistance to blocking at high temperature at 5° C. for three days, no agglomeration was observed in all toners of the Examples and Comparative Examples.

TABLE 1

| | Tone No. | Fixation temperature range | Storage elastic modulus (110° C./140° C.) | Fogging | Definition | Gradient | Image density |
|---|---|---|---|---|---|---|---|
| Example 1 | Toner 1 | 113–188° C. | 19000 Pa/1300 Pa | ○ | ◎ | ◎ | 1.6 |
| Example 2 | Toner 2 | 110–185° C. | 17000 Pa/1250 Pa | ○ | ◎ | ◎ | 1.4 |
| Example 3 | Toner 3 | 110–185° C. | 16800 Pa/1250 Pa | ○ | ◎ | ◎ | 1.4 |
| Example 4 | Toner 4 | 110–185° C. | 16900 Pa/1250 Pa | ○ | ◎ | ◎ | 1.4 |
| Comp. Example 1 | Toner 5 | 115–150° C. | 11000 Pa/900 Pa | ○ | ◎ | ◎ | 1.6 |
| Comp. Example 2 | Toner 6 | None | 5000 Pa/100 Pa | — | — | — | — |
| Comp. Example 3 | Toner 7 | 115–185° C. | 25000 Pa/1800 Pa | x | ○ | ○ | 1.3 |
| Comp. Example 4 | Toner 8 | 122–185° C. | 24000 Pa/1800 Pa | ○ | Standard | Standard | 1.4 |

TABLE 2

| | Toner No. | Fixation temperature range | Fogging | Definition | Gradient | Image density |
|---|---|---|---|---|---|---|
| Example 5 | Toner 9 | 113–188° C. | ○ | ◎ | ◎ | 1.6 |
| Example 6 | Toner 10 | 110–185° C. | ○ | ◎ | ◎ | 1.5 |
| Comp. Example 5 | Toner 11 | 115–150° C. | ○ | ◎ | ◎ | 1.6 |
| Comp. Example 6 | Toner 12 | 115–150° C. | ○ | ◎ | ◎ | 1.5 |
| Comp. Example 7 | Toner 13 | 115–185° C. | x | ○ | ○ | 1.3 |
| Comp. Example 8 | Toner 14 | 122–185° C. | ○ | Standard | Standard | 1.4 |

Although toners 5, 6, 11 and 12 are hardly put in practical use because of narrow range of the fixation temperature, other toners exhibit excellent fixation properties at low temperatures and fixation temperature range, employing a heat roller which is not coated with an anti-offset solution. The spherical or generally spherical toner containing a polyester resin as a binder resin according to the present invention is capable of forming an image having noticeably excellent quality as compared with a toner with an irregular shape obtained by a pulverization method, as is apparent from the comparison with the toners 7, 8, 13 and 14.

Both of the toners 9 and 10 are positive-charge toners and the amount of the positive charge control agent to be added is 0.1% by weight in case of the toner 9, while 3% by weight of the positive charge control agent is added in case of the toner 10. As is apparent from this fact, a positive-charge toner can be obtained by localizing a small amount of the positive charge control agent on the surface of particles like the toner 9.

The definition and gradient were evaluated by employing a test pattern.

Employing the definition and gradient of the toner 7, which resembles closely to a powdered toner used commonly in a test printer in the respect of the shape and particle diameter, as a standard, the evaluation was conducted by comparison with the standard.

○: slightly better than the standard : more better

The fogging was visually judged by the following criteria.

○: good x: severe fogging

The image density was measured by employing a Macbeth densitometer. It is usually desired that the image density is 1.3 or more.

What is claimed is:

1. A toner for electrostatic image development, comprising a binder resin and a colorant, said binder resin being made of a polyester resin, wherein the weight-average molecular weight as measured by gel permeation chromatography of a tetrahydrofuran-soluble fraction of said polyester resin contained in the toner is 30,000 or more and the weight-average molecular weight/number-average molecular weight is 12 or more and, moreover, the area ratio of a molecular weight of 600,000 or more is 0.5% or more and the area ratio of a molecular weight of 10,000 or less is within a range of 20–80%, and wherein said toner has a spherical or generally spherical shape having the average circularity of 0.97 or more.

2. A toner for electrostatic image development according to claim 1, which further comprises a positive charge control agent and is a positive-charge toner.

3. A toner for electrostatic image development according to claim 1, wherein (a) the storage elastic modulus at 110° C. and 1 Hz is within a range of $1\times10^4$–$1\times10^5$ Pa and (b) the storage elastic modulus at 140° C. and 1 Hz is within a range of $1\times10^3$–$1\times10^4$ Pa in the measurement of the viscoelasticity.

4. A toner for electrostatic image development according to claim 1, wherein the content of a tetrahydrofuran-insoluble fraction of said polyester resin contained in the toner is within a range of 0.01–20% by weight.

5. A toner for electrostatic image development according to claim 1, wherein said binder resin is made of a blend resin of a crosslinked polyester resin and a straight-chain polyester resin.

6. A toner for electrostatic image development according to claim 1, which is obtained by a production method comprising the first step of mixing a mixture of a binder resin made of a polyester resin having a carboxyl group and a colorant with an aqueous medium in the presence of a base and emulsifying the admixture to form resin particles wherein said colorant is included in said binder resin; and the second step of separating said resin particles from the liquid medium and drying them.

7. A toner for electrostatic image development according to claim 2, which is obtained by a production method comprising the first step of mixing a mixture of a binder resin made of a polyester resin having a carboxyl group, a colorant and a positive charge control agent with an aqueous medium in the presence of a base and emulsifying the admixture to form resin particles wherein said colorant is included in said binder resin; and the second step of separating said resin particles from said liquid medium and drying them.

8. A toner for electrostatic image development according to claim 2, which is obtained by a production method comprising:

the first step of mixing a mixture containing a binder resin made of a polyester resin having a carboxyl group and a colorant with an aqueous medium in the presence of a basic neutralizer and emulsifying the admixture to obtain a liquid medium of colored particles (I);

the second step of mixing a mixture containing, as an essential component, a resin capable of being provided with the self-water dispersibility and/or water solubility by neutralization and a positive charge control agent with an aqueous medium in the presence of a neutralizer and emulsifying the admixture to obtain a liquid medium of microparticles (II) containing said positive charge control agent, the average particle diameter of which is smaller than that of said colored particles (I);

the third step of adding said liquid medium of said microparticles (II) to said liquid medium of said colored particles (I), uniformly mixing them, adding a neutralizer having the reverse polarity as compared with the second step thereby to deposit said microparticles (II) on the surface of said colored particles (I); and the fourth step of separating said colored particles (I) with said microparticles (II) adhered on the surface from said liquid medium and drying to obtain toner particles.

9. An image forming method employing a toner for electrostatic image development whose binder resin is made of a polyester resin, which comprises employing a toner for electrostatic image development wherein the average circularity is 0.97 or more, the weight-average molecular weight as measured by gel permeation chromatography of a tetrahydrofuran-soluble fraction of said polyester resin contained in the toner is 30,000 or more, the weight-average molecular weight/number-average molecular weight is 12 or more, the area ratio of a molecular weight of 600,000 or more is 0.5% or more, and the area ratio of a molecular weight of 10,000 or less is within a range of 20–80%, and employing no anti-offset solution on a fixing heat roller.

10. An image forming method according to claim 9, wherein said toner has (a) the storage elastic modulus at 110° C. and 1 Hz within a range of $1\times10^4$–$1\times10^5$ Pa and (b) the storage elastic modulus at 140° C. and 1 Hz within a range of $1\times10^3$–$1\times10^4$ Pa in the measurement of the viscoelasticity.

11. A toner for electrostatic image development according to claim 1, wherein the acid value of said binder resin is within a range of 1–30 KOHmg/g.

12. A toner for positive-charge electrostatic image development according to claim 2, wherein the acid value of said binder resin is within a range of 1–20 KOHmg/g.

* * * * *